US011598354B2

(12) United States Patent
Jung et al.

(10) Patent No.: US 11,598,354 B2
(45) Date of Patent: Mar. 7, 2023

(54) HYDRAULIC MACHINE

(71) Applicant: Volvo Construction Equipment AB, Eskilstuna (SE)

(72) Inventors: Taerang Jung, Gyeongsangnam-do (KR); Sangkyu Joo, Gyeongsangnam-do (KR); Hoenghwan Ahn, Gyeongsangnam-do (KR); Seonggeun Yun, Gyeongsangnam-do (KR); Seunghyun Lee, Gyeongsangnam-do (KR); Byoungho Lee, Gyeongsangnam-do (KR)

(73) Assignee: Volvo Construction Equipment AB, Eskilstuna (SE)

( * ) Notice: Subject to any disclaimer, the term of this patent is extended or adjusted under 35 U.S.C. 154(b) by 0 days.

(21) Appl. No.: 17/743,540

(22) Filed: May 13, 2022

(65) Prior Publication Data

US 2022/0364328 A1 Nov. 17, 2022

(30) Foreign Application Priority Data

May 13, 2021 (KR) ..... 10-2021-0062079

(51) Int. Cl.
*F15B 21/14* (2006.01)
*E02F 9/22* (2006.01)
(Continued)

(52) U.S. Cl.
CPC ..... *F15B 21/14* (2013.01); *E02F 9/2004* (2013.01); *E02F 9/2217* (2013.01);
(Continued)

(58) Field of Classification Search
CPC ..... F15B 1/021; F15B 1/024; F15B 21/008; F15B 21/14; F15B 2211/8613; F15B 2211/8616; E02F 9/2217
See application file for complete search history.

(56) References Cited

U.S. PATENT DOCUMENTS 7,444,809 B2 * 11/2008 Smith ..... F15B 11/006 60/413
7,530,434 B2 * 5/2009 Bitter ..... F15B 1/021 60/413

(Continued)

FOREIGN PATENT DOCUMENTS

JP 5257807 B2 8/2013

OTHER PUBLICATIONS

Extended European Search Report dated Oct. 12, 2022, for European Patent Application No. 22171832.3, 10 pages.

*Primary Examiner* — Michael Leslie
(74) *Attorney, Agent, or Firm* — Sage Patent Group

(57) ABSTRACT

A hydraulic machine. A boom actuator includes a large chamber and a small chamber. A recovery unit receives fluid discharged from the large chamber and then recovers energy. A recovery line connects the large chamber and the recovery unit. An accumulator is connected to a first point on the recovery line. A discharge valve is disposed on the recovery line between the first point and the recovery unit. A first sensor measures a pressure in the accumulator. A controller controls opening and closing of the discharge valve. The controller performs anti-bouncing control of: determining a target pressure in the accumulator corresponding to a load pressure applied to fluid in the large chamber by a load according to a predetermined correspondence; and controlling the opening and closing of the discharge valve such that the pressure in the accumulator measured by the first sensor reaches the target pressure.

13 Claims, 5 Drawing Sheets

(51) Int. Cl.
*F15B 1/02* (2006.01)
*E02F 9/20* (2006.01)

(52) U.S. Cl.
CPC ..... *E02F 9/2292* (2013.01); *E02F 9/2228* (2013.01); *F15B 1/021* (2013.01); *F15B 1/024* (2013.01); *F15B 2211/8613* (2013.01); *F15B 2211/8616* (2013.01)

(56) References Cited

U.S. PATENT DOCUMENTS

| | | | | |
|---|---|---|---|---|
| 7,712,309 | B2 * | 5/2010 | Vigholm | E02F 9/2217 60/419 |
| 9,279,236 | B2 | 3/2016 | Zhang et al. | |
| 10,400,802 | B2 * | 9/2019 | Sugano | E02F 9/2217 |
| 10,704,229 | B2 * | 7/2020 | Uemura | F15B 21/14 |
| 10,890,199 | B2 * | 1/2021 | Hahn | F15B 1/033 |
| 11,401,693 | B2 * | 8/2022 | Kim | F15B 1/024 |
| 2022/0162829 | A1 * | 5/2022 | Jung | E02F 9/2285 |

* cited by examiner

HYDRAULIC MACHINE

CROSS-REFERENCE TO RELATED APPLICATIONS

The present application claims benefit of priority to Korean Patent Application No. 10-2021-0062079, filed May 13, 2021, and is assigned to the same assignee as the present application and is incorporated herein by reference.

FIELD

The present disclosure relates to a hybrid hydraulic machine and, more particularly, to a hybrid hydraulic machine configured to recover energy from fluid discharged from a boom actuator in a boom down operation and effectively reduce bouncing or impacts occurring in a boom down motion.

BACKGROUND

A hydraulic machine is an apparatus configured to carry out work by supplying high pressure fluid to (an actuator of) a working device. To improve the fuel efficiency of the hydraulic machine, a technology of recovering energy contained in fluid discharged from an actuator of the working device has been proposed. Such a technology may reduce the consumption of fuel by recovering energy.

SUMMARY

Various aspects of the present disclosure provide a hybrid hydraulic machine configured to recover energy from fluid discharged from a boom actuator in a boom down operation so as to reduce the consumption of fuel and effectively reduce bouncing or impacts occurring in a boom down motion.

According to an aspect, a hydraulic machine may include: a boom actuator including a large chamber and a small chamber; a recovery unit configured to receive fluid discharged from the large chamber and to then recover energy; a recovery line connecting the large chamber and the recovery unit; an accumulator connected to a first point on the recovery line; a discharge valve disposed on the recovery line between the first point and the recovery unit; a first sensor configured to measure a pressure in the accumulator; and a controller configured to control opening and closing of the discharge valve. The controller may perform anti-bouncing control of: determining a target pressure in the accumulator corresponding to a load pressure applied to fluid in the large chamber by a load according to a predetermined correspondence; and controlling the opening and closing of the discharge valve such that the pressure in the accumulator measured by the first sensor reaches the target pressure.

In some embodiments, the hydraulic machine may further include: a second sensor configured to measure a pressure in the large chamber; and a third sensor configured to measure a pressure in the small chamber. The load pressure may be Pa−Pb/(Aa/Ab), where Pa is the pressure in the large chamber measured by the second sensor, Pb is pressure in the small chamber measured by the third sensor, Aa is an area of the large chamber, and Ab is an area of the small chamber.

In some embodiments, the predetermined correspondence may be set such that the target pressure increases with increase in the load pressure.

According to embodiments of the present disclosure, the hybrid hydraulic machine can reduce consumption of fuel by recovering energy and effectively reduce bouncing or impacts occurring in a boom down motion.

The methods and apparatuses of the present disclosure have other features and advantages that will be apparent from or that are set forth in greater detail in the accompanying drawings, the disclosures of which are incorporated herein, and in the following Detailed Description, which together serve to explain certain principles of the present disclosure.

DETAILED DESCRIPTION

Hereinafter, embodiments of the present disclosure will be described in detail with reference to the accompanying drawings.

Figure 1:
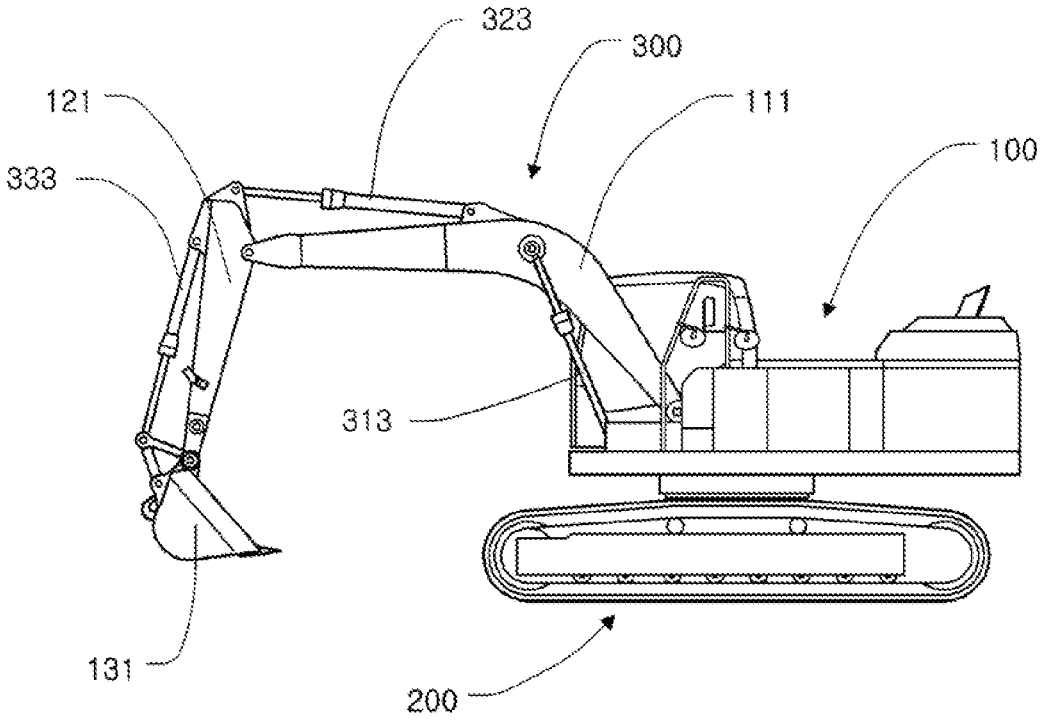
FIG. 1 is a schematic diagram illustrating an external appearance of a hydraulic machine according to some embodiments.

FIG. 1 is a schematic diagram illustrating an external appearance of a hydraulic machine according to some embodiments.

A hydraulic machine may carry out work by actuating a working device 300 using hydraulic pressure. In some embodiments, the hydraulic machine may be a construction machine.

In some embodiments, the hydraulic machine may be an excavator as illustrated in FIG. 1. The hydraulic machine may include an upper structure 100, an under structure 200, and the working device 300.

The under structure 200 includes a travel actuator allowing the hydraulic machine to travel. The travel actuator may be a hydraulic motor.

The upper structure 100 may include a working fluid tank, a pump, a power source, a control valve, and the like. In addition, the upper structure 100 may include a swing actuator allowing the upper structure 100 to rotate with respect to the under structure 200. The swing actuator may be a hydraulic motor.

The working device 300 allows the excavator to carry out work. The working device 300 may include a boom 111, an arm 121, and a bucket 131, as well as a boom actuator 313, an arm actuator 323, and a bucket actuator 333 actuating the boom 111, the arm 121, and the bucket 131, respectively. The boom actuator 313, the arm actuator 323, and the bucket actuator 333 may be hydraulic cylinders, respectively.

Figure 2:
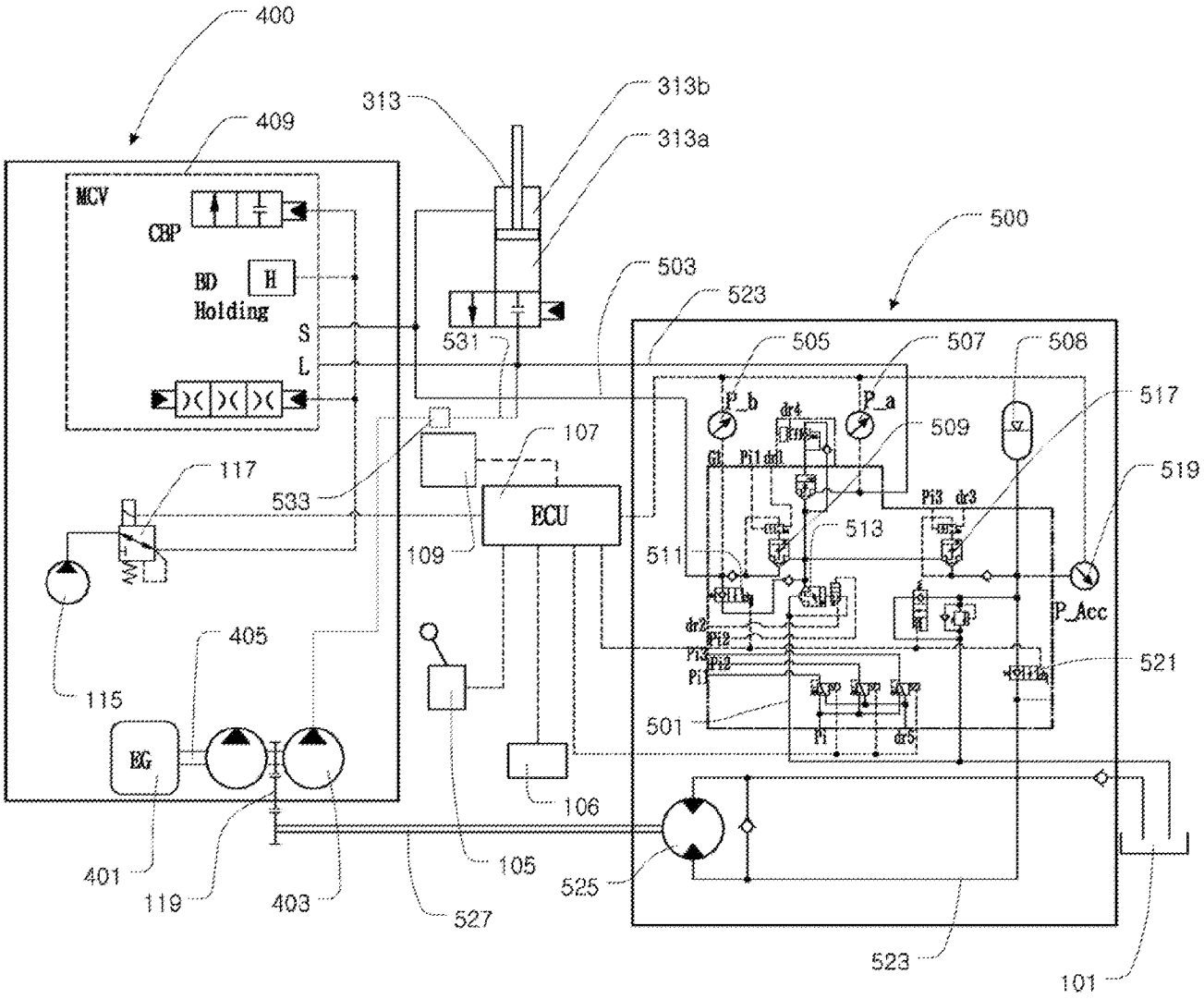
FIG. 2 illustrates a hydraulic circuit of a hydraulic machine according to some embodiments.

FIG. 2 illustrates a hydraulic circuit of a hydraulic machine according to some embodiments.

In some embodiments, the hydraulic machine may include the boom actuator 313, an energy recovery circuit 500, a tank 101, and a controller 107. The energy recovery circuit 500 may be provided between the boom actuator 313 and the tank 101. The energy recovery circuit 500 may be connected to the boom actuator 313 to recover energy in fluid discharged from the boom actuator 313. In some embodiments, the energy recovery circuit 500 may include a return valve 513, a regeneration valve 509, a charging valve 517, and a recovery unit 525.

In some embodiments, the hydraulic machine may include an energy consumption circuit 400. The energy consumption circuit 400 may be provided between the tank 101 and the boom actuator 313. The energy consumption circuit 400 is a circuit connected to the boom actuator 313 to supply high pressure fluid to the boom actuator 313 or return fluid discharged from the boom actuator 313 to the tank 101. In some embodiments, the energy consumption circuit 400 may include a power source 401, a main pump 403, and a control valve 409. The main pump 403 may direct pressurized fluid to the boom actuator 313. The power source 401 may drive the main pump 403. In some embodiments, the power source 401 may include an engine.

In some embodiments, the hydraulic machine may be configured to actuate the working device using the energy consumption circuit 400 at normal time and recover energy using the energy recovery circuit 500 when a hybrid function is intended to be performed.

In some embodiments, the power source 401 may drive the main pump 403 by supplying power to the main pump 403 through a main shaft 405. The main pump 403 may pressurize fluid and direct the pressurized fluid to the boom actuator 313. The boom actuator 313 may receive the pressurized fluid from the main pump 403 and return fluid toward the tank 101. The boom actuator 313 may actuate the boom by providing the force of the pressurized fluid received from the main pump 403 to the boom.

In some embodiments, the boom actuator 313 may be a hydraulic cylinder, and may include a large chamber 313*a* and a small chamber 313*b*. Since a piston rod connected to the boom extends through the small chamber 313*b*, an area Ab in which the fluid inside the small chamber 313*b* is in contact with the piston is smaller than an area Aa in which the fluid inside the large chamber 313*a* is in contact with the piston, due to the area occupied by the piston rod. Referring to FIG. 1, in a boom down operation in which the boom is lowered, the piston rod is also lowered. Consequently, fluid enters the small chamber 313*b*, while fluid is discharged from the large chamber 313*a*.

The control valve 409 may control the directions of flows of fluid between the main pump 403, the tank 101, and the boom actuator 313 by fluidly connecting the main pump 403, the tank 101, and the boom actuator 313. In some embodiments, the control valve 409 may be in a neutral position, a first non-neutral position, or a second non-neutral position. When the control valve 409 is in the neutral position, the control valve 409 may be operated not to fluidly communicate with the boom actuator 313 and return the fluid that has flowed from the main pump 403 to the tank 101 through a central bypass path. When the control valve 409 is in the first non-neutral position, the control valve 409 may prevent the fluid that has flowed from the main pump 403 from returning to the tank 101 through the central bypass path, direct the fluid that has flowed from the main pump 403 to the small chamber 313*b*, and direct the fluid that has flowed from the large chamber 313*a* to the tank 101, thereby moving the boom down. When the control valve 409 is in the second non-neutral position, the control valve 409 may prevent the fluid that has flowed from the main pump 403 from returning to the tank 101 through the central bypass path, direct the fluid that has flowed from the main pump 403 to the large chamber 313*a*, and direct the fluid that has flowed from the small chamber 313*b* to the tank 101, thereby moving the boom up.

In some embodiments, the hydraulic machine may include a first operator input device 105 to move the control valve 409. An operator may input his/her desire to raise or lower the boom by operating the first operator input device 105. In some embodiments, the first operator input device 105 may be a lever, but the present disclosure is not limited thereto.

In some embodiments, the first operator input device 105 may be an electrical input device, and may generate an electrical signal indicative of the operator's desire and transmit the electrical signal to the controller 107. In some embodiments, the hydraulic machine may include a pilot pump 115 and an electronic proportional pressure reducing valve 117. When an electrical signal is received from the first operator input device 105, the controller 107 may responsively operate the electronic proportional pressure reducing valve 117 by transmitting a control signal to the electronic proportional pressure reducing valve 117. When the electronic proportional pressure reducing valve 117 is in a first position, the electronic proportional pressure reducing valve 117 may operate the control valve 409 by directing pilot fluid that has flowed from the pilot pump 115 to the control valve 409. When the electronic proportional pressure reducing valve 117 is in a second position, the electronic proportional pressure reducing valve may block flow of the pilot fluid from the pilot pump 115 to the control valve 409 and allow the pilot fluid that has been provided to the control valve 409 to drain.

The return valve 513 may be provided between the large chamber 313*a* and the tank 101 to allow or block flow of fluid from the large chamber 313*a* to the tank 101. The regeneration valve 509 may connect the large chamber 313*a* and the small chamber 313*b* to allow or block flow of fluid from the large chamber 313*a* to the small chamber 313*b*. The charging valve 517 may be provided between the large chamber 313*a* and the recovery unit 525 to allow or block flow of fluid from the large chamber 313*a* to the recovery unit 525.

The recovery unit 525 is a power recovering component. In some embodiments, the recovery unit 525 may be a hydraulic motor (e.g., an assist motor). The assist motor may assist the power source 401 by providing the recovered power for the power source 401. In this regard, in some embodiments, the hydraulic machine may include a power transmission. The power transmission may be connected to the power source 401 and the assist motor to transmit power therebetween. In some embodiments, the power transmission may include the main shaft 405 connecting the power source 401 and the main pump 403, an assist shaft 527 connected to the assist motor, and a power transmission part 119. In some embodiments, the power transmission part 119 may include a gear train as illustrated in FIG. 2. However, the present disclosure is not limited thereto, and a variety of other embodiments are possible.

In some embodiments, the hydraulic machine may include a second operator input device 106 configured to receive a desired input by the operator to select or deselect a hybrid mode. When the desire to select the hybrid mode is input to the second operator input device 106 and a boom down desire is input to the first operator input device 105, the controller 107 may control the electronic proportional pressure reducing valve 117 such that the pilot fluid is not supplied to the control valve 409, thereby moving the control valve 409 to the neutral position. In this manner, the controller 107 may block flow of fluid between the boom actuator 313 and the energy consumption circuit 400. Thus, in a situation in which the hybrid mode is selected, the boom down operation may only be induced by the weight thereof without the supply of the pressurized fluid by the main pump 403. When a desire to deselect the hybrid mode is input to the second operator input device 106 or no boom down desire is input to the first operator input device 105 even in the case that the desire to deselect the hybrid mode is input to the second operator input device 106, the controller 107 may move the return valve 513, the regeneration valve 509, and the charging valve 517 to block flow of fluid between the boom actuator 313 and the energy recovery circuit 500.

In some embodiments, in the boom down operation in which the boom is lowered, the return valve 513 may be operated to block flow of fluid from the large chamber 313*a* to the tank 101. In the boom down operation, the regeneration valve 509 may be operated to allow flow of fluid from the large chamber 313*a* to the small chamber 313*b*. In the boom down operation, the charging valve 517 may be operated to allow flow of fluid from the large chamber 313*a* to the recovery unit 525.

In some embodiments, the energy recovery circuit 500 may include a recovery line 523 connecting the large chamber 313*a* and the recovery unit 525. In some embodiments, the charging valve 517 may be provided on the recovery line 523. In some embodiments, the energy recovery circuit 500 may include a discharge valve 521 provided on the recovery line 523. In some embodiments, the energy recovery circuit 500 may include an accumulator 508 connected to the recovery line 523, in a first location between the charging valve 517 and the discharge valve 521. The charging valve 517 may allow or block flow of fluid from the large chamber 313*a* to the accumulator 508 through the recovery line 523. The discharge valve 521 is disposed on the recovery line 523, at a location between the first location and the recovery unit 525, and may allow or block flow of fluid from the accumulator 508 to the recovery unit 525. In the boom down operation, the discharge valve 521 may be operated to allow flow of fluid to the recovery unit 525.

In some embodiments, in the boom down operation, the controller 107 may control the regeneration valve 509 and the charging valve 517 such that about half of a high-pressure flow rate discharged from the large chamber 313*a* flows through the regeneration valve 509 to be regenerated and the remaining amount of the flow rate flows through the charging valve 517 to be stored in the accumulator 508. The stored flow rate is supplied to the recovery unit 525 through the discharge valve 521. Here, how much boom down energy is to be lost is determined depending on how much areas the regeneration valve 509, the charging valve 517, and the discharge valve 521 are controlled to be opened. In some embodiments, in the boom down operation (i.e., when receiving a boom down operation desire input by the operator using the first operator input device 105), the controller 107 may open the regeneration valve 509 and the charging valve 517 to the maximum extent and close the return valve 513 so as to minimize pressure loss.

In some embodiments, the hydraulic machine may include a first sensor 519 measuring pressure in the accumulator 508. In addition, the hydraulic machine may include a second sensor 507 measuring pressure in the large chamber 313*a* and a third sensor 505 measuring pressure in the small chamber 313*b*.

In some embodiments, the hydraulic machine may include a third operator input device 109 by which an operator inputs a desire to select or deselect an anti-bouncing mode. The controller 107 may perform anti-bouncing control only when the desire to select the anti-bouncing mode is input to the third operator input device 109.

In some embodiments, the hydraulic machine may include an auxiliary line 531 connecting the main pump 403 to a second point of the recovery line 523 upstream of a first point of the recovery line 523. Even in the case that the hybrid mode is selected, when the pressure of fluid charged in the accumulator 508 is not sufficient (e.g., when the boom down operation is performed directly after the hybrid mode is selected), bouncing may not be effectively reduced. Thus, the main pump 403 may be configured to supply pressurized fluid to the accumulator 508 to assist in rapidly increasing the pressure in the accumulator 508 to a target pressure.

The auxiliary valve 533 may be provided on the auxiliary line 531 to open or close the auxiliary line 531. In some embodiments, the controller 107 may open the auxiliary valve 533 when performing the anti-bouncing control. For example, when the desire to select the hybrid mode is input to the second operator input device 106, the boom down operation desire is input to the first operator input device 105, and the desire to select the anti-bouncing mode is input to the third operator input device 109, the controller 107 may open the auxiliary valve 533.

In the above embodiments, the desires are input to the second operator input device 106 and the third operator input device 109, respectively, in order to activate the anti-bouncing function, but the present disclosure is not limited thereto. For example, in some alternative embodiments, when the desire to select the anti-bouncing mode is input to the third operator input device 109 by the operator, the controller 107 may control corresponding valves to be opened or closed so that the hybrid function and the anti-bouncing function are performed simultaneously.

Figure 3:
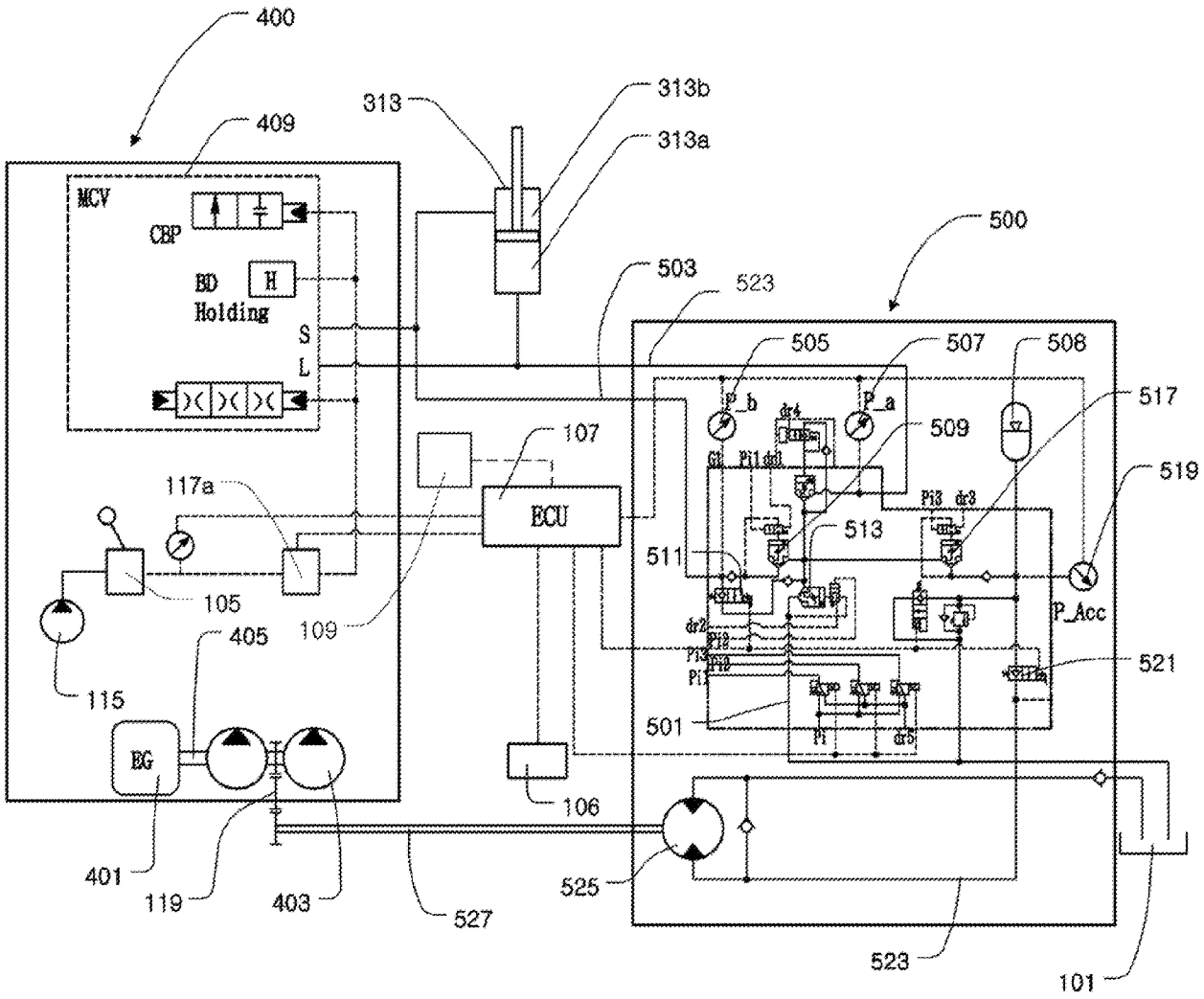
FIG. 3 illustrates a hydraulic circuit of a hydraulic machine according to some embodiments.

FIG. 3 illustrates a hydraulic circuit of a hydraulic machine according to some embodiments.

In some alternative embodiments, the first operator input device 105 may be a hydraulic input device including a built-in pressure reducing valve (not shown), and the hydraulic machine may include an auxiliary valve 117*a*. In these embodiments, the pilot pump 115 may be connected to the pressure reducing valve of the first operator input device 105, and the pressure reducing valve may transmit a hydraulic signal corresponding to the operator's desire input through the first operator input device 105 to the auxiliary valve 117*a*. In some embodiments, the hydraulic machine may include a sensor measuring the pressure of the hydraulic signal transmitted to the auxiliary valve 117*a* by the pressure reducing valve. The sensor may generate an electrical signal corresponding to the hydraulic signal and provide the electrical signal to the controller 107. Thus, although the controller 107 is not directly connected to the first operator input device 105, the controller 107 may determine what desire has been input by the operator, i.e., whether a boom down operation desire is input or a boom up operation desire is input. When a desire to deselect the hybrid mode is input through the second operator input device 106, a hydraulic signal generated by the first operator input device 105 may be transmitted to the control valve 409 through the auxiliary valve 117*a*. However, when the desire to select the hybrid mode is input to the second operator input device 106, even in the case that the boom down desire is input to the first operator input device 105, the controller 107 may control the auxiliary valve 117*a* such that the pilot fluid is not supplied to the control valve 409, thereby moving the control valve 409 to the neutral position. In this manner, the controller 107 may block flow of fluid between the boom actuator 313 and the energy consumption circuit 400.

Figure 4:
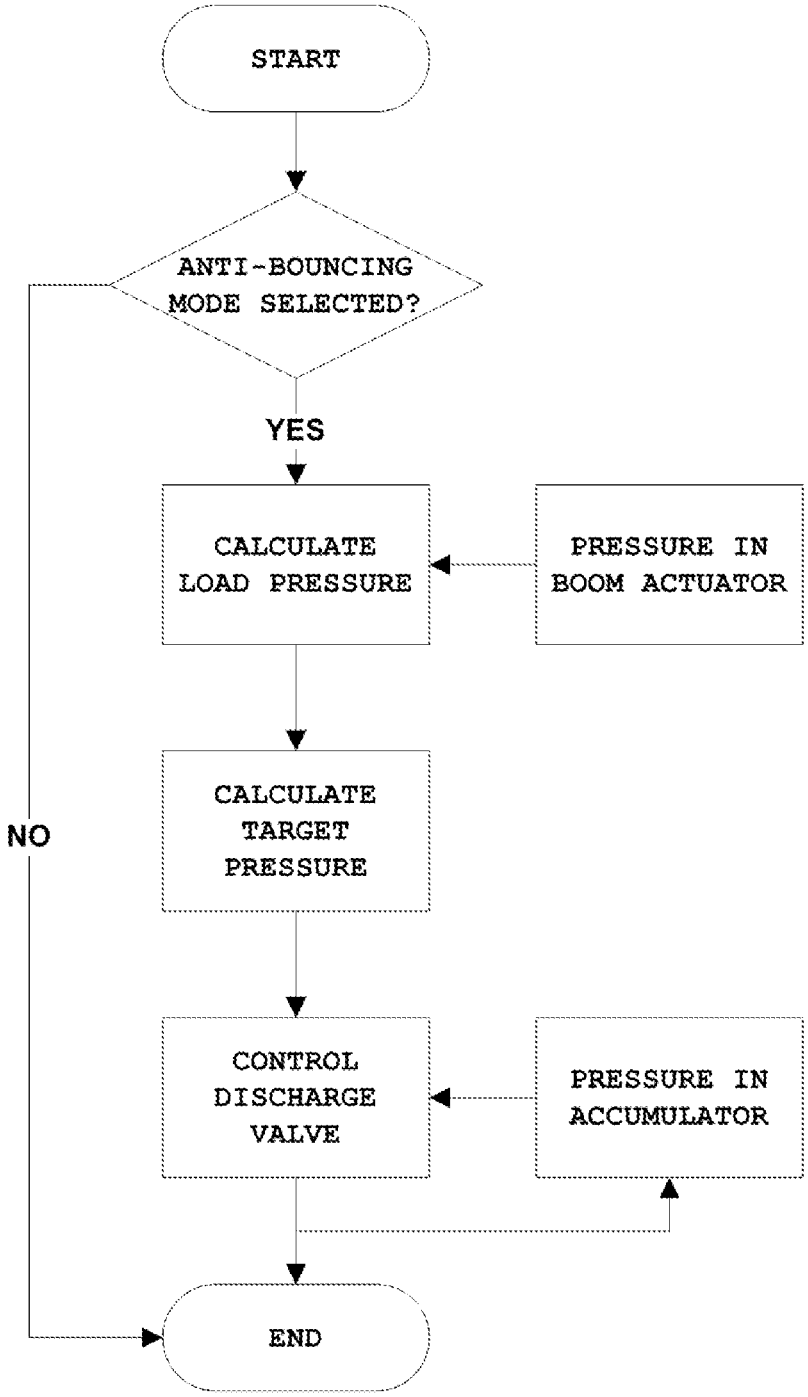
FIG. 4 is a flowchart illustrating an anti-bouncing control method according to some embodiments.
Figure 5:
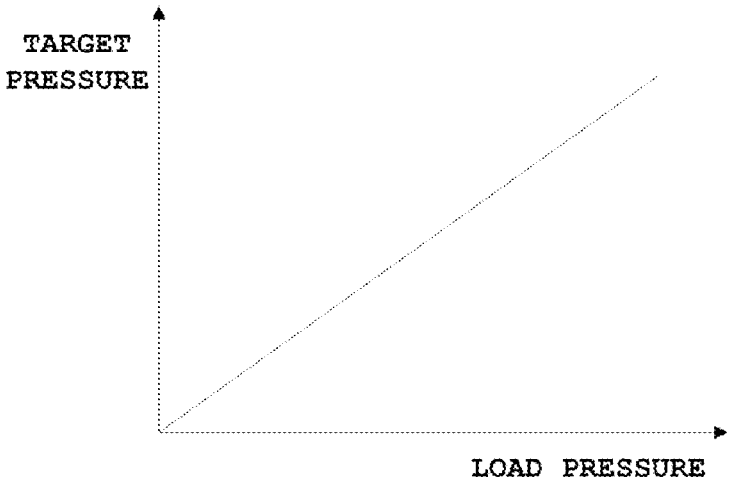
FIG. 5 is a graph illustrating an example of the correspondence between a load pressure and a target pressure, set before an anti-bouncing control is performed.

FIG. 4 is a flowchart illustrating anti-bouncing control method according to some embodiments, and FIG. 5 is a graph illustrating an example of the correspondence between a load pressure and a target pressure, set before the anti-bouncing is performed.

The hydraulic machine illustrated in FIGS. 2 and 3 may reduce the consumption of fuel by recovering energy using the accumulator 508. In addition, according to the present disclosure, bouncing occurring in the operation of the boom may be reduced by regulating the pressure in the accumulator 508.

In general, a boom down motion may create a large amount of bouncing of the working device. Thus, a rapid boom down operation may impair the safety of the hydraulic machine and create an unpleasant operating condition for the operator. Accordingly, the present disclosure proposes a method of reducing such bouncing by regulating the pressure in the accumulator 508.

i) In this regard, as illustrated in the figures, first, the controller 107 may determine whether or not a desire to select the anti-bouncing mode is input by the operator.

ii) Thereafter, the controller 107 may calculate a load pressure $P_L$ applied to fluid in the large chamber 313*a* of the boom actuator 313. In some embodiments, the controller 107 may calculate the load pressure using a pressure Pa in the large chamber 313*a* measured by the second sensor 507 and a pressure Pb in the small chamber 313*b* measured by the third sensor 505, as follows:

$$P_L = Pa - Pb/(Aa/Ab),$$

where Aa is an area in which fluid within the large chamber 313*a* is in contact with the piston, and Ab is an area in which fluid within the small chamber 313*b* is in contact with the piston.

iii) Subsequently, the controller 107 may obtain a target pressure corresponding to the calculated load pressure according to the preset correspondence between load pressures applied to the boom actuator 313 and target pressures $P_T$ in the accumulator 508.

The correspondence between the load pressure $P_L$ and the target pressure $P_T$ may be provided in a variety of forms. For example, the correspondence may be provided in the form of a lookup table or the following functional relationship:

$$P_T = f(P_L)$$

In some embodiments, the load pressure $P_L$ and the target pressure $P_T$ may have the following functional relationship:

$$P_T = a \times P_L + b \text{ (where } a \text{ and } b \text{ are constants respectively, and } a > 0)$$

In some embodiments, a fourth operator input device (not shown) may be provided to allow the operator to select at least one of a and b. When a greater value is selected for a, the target pressure has a greater value for the same load pressure, and thus a mode in which the anti-bouncing acts strongly is selected.

Although FIG. 5 illustrates an embodiment in which the load pressure and the target pressure have a linear relationship and b is 0, this is only an example, and the present disclosure is not limited thereto. To effectively reduce the bouncing that would be caused by the large load pressure, a large pressure of fluid in the accumulator 508 may be advantageous. Thus, when the load pressure applied to the large chamber 313*a* of the boom actuator 313 is increased by the load in the boom down operation, the target pressure in the accumulator 508 resisting to the boom down operation to effectively reduce the bouncing may also be linearly or non-linearly increased.

iv) Afterwards, the controller 107 may control the discharge valve 521 to be opened or closed so that the pressure in the accumulator 508 reaches the target pressure. For example, feedback control may be performed in such a manner that the discharge valve 521 is closed when the pressure Pc in the accumulator 508 measured by the first sensor 519 is less than the target pressure and the discharge valve 521 is opened when the pressure Pc in the accumulator 508 is greater than the target pressure.

Figure 6:
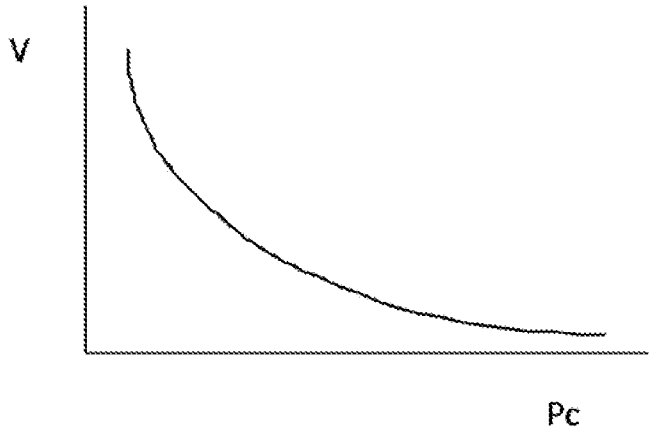
FIG. 6 is a graph illustrating an example of the relationship between a pressure in an accumulator and a speed of a working device while anti-bouncing control is performed according to some embodiments.

FIG. 6 is a graph illustrating an example of the relationship between a pressure in an accumulator and a speed of a working device while the anti-bouncing control is performed according to some embodiments.

As described in FIG. 6, in the boom down operation, it is possible to control the pressure Pc in the accumulator 508 and thus the boom down speed V by controlling the opening and closing of the discharge valve 521. Since the pressure Pc in the accumulator 508 acts as a resistance to the boom down motion, the boom down speed V is reduced when the pressure Pc in the accumulator 508 is increased.

The foregoing descriptions of specific exemplary embodiments of the present disclosure have been presented with respect to the drawings and are not intended to be exhaustive or to limit the present disclosure to the precise forms disclosed herein, and many modifications and variations would obviously be possible for a person having ordinary skill in the art in light of the above teachings.

It is intended, therefore, that the scope of the present disclosure not be limited to the foregoing embodiments, but be defined by the Claims appended hereto and their equivalents.

What is claimed is:

1. A hydraulic machine comprising:

a boom actuator comprising a large chamber and a small chamber;

a recovery unit configured to receive fluid discharged from the large chamber and to then recover energy;

a recovery line connecting the large chamber and the recovery unit;

an accumulator connected to a first point on the recovery line;

a discharge valve disposed on the recovery line between the first point and the recovery unit;

a first sensor configured to measure a pressure in the accumulator; and a controller configured to control opening and closing of the discharge valve, wherein the controller performs anti-bouncing control of:

determining a target pressure in the accumulator corresponding to a load pressure applied to fluid in the large chamber by a load according to a predetermined correspondence; and controlling the opening and closing of the discharge valve such that the pressure in the accumulator measured by the first sensor reaches the target pressure.

2. The hydraulic machine of claim 1, further comprising:

a second sensor configured to measure a pressure in the large chamber; and a third sensor configured to measure a pressure in the small chamber, wherein the load pressure is Pa−Pb/(Aa/Ab), where Pa is the pressure in the large chamber measured by the second sensor, Pb is pressure in the small chamber measured by the third sensor, Aa is an area of the large chamber, and Ab is an area of the small chamber.

3. The hydraulic machine of claim 1, wherein the predetermined correspondence is set such that the target pressure increases with increase in the load pressure.

4. The hydraulic machine of claim 1, wherein the predetermined correspondence is:

$$P_T=f(P_L),$$

where $P_T$ is the target pressure, and $P_L$ is the load pressure.

5. The hydraulic machine of claim 4, wherein the predetermined correspondence is:

$$P_T=a\times P_L+b,$$

where a and b are constants respectively, and a>0.

6. The hydraulic machine of claim 5, further comprising a fourth operator input device to which a desire to select a value of a is input by an operator.

7. The hydraulic machine of claim 1, wherein the predetermined correspondence is provided in a form of a lookup table.

8. The hydraulic machine of claim 1, further comprising a third operator input device to which a desire to select or deselect an anti-bouncing mode is input by an operator, wherein the controller performs the anti-bouncing control when the desire to select the anti-bouncing mode is input to the third operator input device.

9. The hydraulic machine of claim 8, further comprising:

a first operator input device to which a desire to operate the boom actuator is input by the operator; and a second operator input device to which a desire to select or deselect a hybrid mode is input by the operator, wherein the controller performs the anti-bouncing control when the desire to select the hybrid mode is input to the second operator input device and a boom down operation desire is input to the first operator input device.

10. The hydraulic machine of claim 9, further comprising a charging valve disposed on the recovery line between the first point and the boom actuator, wherein the controller opens the charging valve when the desire to select the hybrid mode is input to the second operator input device and the boom down operation desire is input to the first operator input device.

11. The hydraulic machine of claim 10, further comprising:

a pump configured to supply pressurized fluid to the boom actuator; and a control valve disposed between the pump and the boom actuator to be movable between a neutral position to prevent the pressurized fluid from being supplied to the boom actuator and a non-neutral position to allow the pressurized fluid to be supplied to the boom actuator according to an input to the first operator input device, wherein the controller moves the control valve to the neutral position when the desire to select the hybrid mode is input to the second operator input device and the boom down operation desire is input to the first operator input device.

12. The hydraulic machine of claim 1, further comprising:

a pump configured to supply pressurized fluid to the boom actuator;

an auxiliary line connecting the pump to a second point upstream of the first point on the recovery line; and an auxiliary valve configured to open or close the auxiliary line.

13. The hydraulic machine of claim 12, wherein the controller opens the auxiliary valve when performing the anti-bouncing control.

* * * * *